US007048356B2

(12) United States Patent
Ishikawa et al.

(10) Patent No.: US 7,048,356 B2
(45) Date of Patent: May 23, 2006

(54) METHOD AND APPARATUS FOR INK JET PRINTING

(75) Inventors: Takuei Ishikawa, Tokyo (JP); Koichiro Nakazawa, Tokyo (JP); Katsuhiro Shirota, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/962,618

(22) Filed: Oct. 13, 2004

(65) Prior Publication Data

US 2005/0083363 A1 Apr. 21, 2005

(30) Foreign Application Priority Data

Oct. 16, 2003 (JP) ..... 2003-356292

(51) Int. Cl.
*B41J 2/15* (2006.01)

(52) U.S. Cl. ..... 347/41; 347/15; 347/96

(58) Field of Classification Search ..... 347/43, 347/15, 41, 95, 96, 98, 100, 16
See application file for complete search history.

(56) References Cited

U.S. PATENT DOCUMENTS

| | | | | |
|---|---|---|---|---|
| 4,723,129 | A | 2/1988 | Endo et al. | |
| 4,740,796 | A | 4/1988 | Endo et al. | |
| 5,635,969 | A | 6/1997 | Allen | |
| 5,933,164 | A * | 8/1999 | Sato et al. | 347/43 |
| 6,084,619 | A | 7/2000 | Takemoto et al. | |
| 6,123,411 | A | 9/2000 | Inui et al. | |
| 6,158,834 | A * | 12/2000 | Kato et al. | 347/9 |
| 6,464,349 | B1 | 10/2002 | Moriyama et al. | |
| 6,474,778 | B1 * | 11/2002 | Koitabashi et al. | 347/43 |
| 2003/0117453 | A1 | 6/2003 | Goto et al. | |

FOREIGN PATENT DOCUMENTS

| | | |
|---|---|---|
| EP | 0 534 634 | 3/1993 |
| JP | 61-59911 | 12/1986 |
| JP | 61-59912 | 12/1986 |
| JP | 61-59914 | 12/1986 |
| JP | 5-202328 | 8/1993 |
| JP | 7-195823 | 8/1995 |
| JP | 8-39795 | 2/1996 |
| JP | 8-216393 | 8/1996 |
| JP | 8-281974 | 10/1996 |
| JP | 9-207424 | 8/1997 |
| JP | 9-300665 | 11/1997 |
| JP | 10-193579 | 7/1998 |
| JP | 2001-138554 | 5/2001 |
| JP | 2003-25563 | 1/2003 |

* cited by examiner

*Primary Examiner*—Lamson Nguyen
(74) *Attorney, Agent, or Firm*—Fitzpatrick, Cella, Harper & Scinto

(57) ABSTRACT

A method and apparatus for ink jet printing enables a high grade image with the reduced ununiformity of colors to be inexpensively printed. A scan of a print head is executed to apply a reacting liquid to a print medium so that the number of reacting liquid dots impacting a unit area is reduced as the scan moves from a printing start-point of the reacting liquid to a printing end-point. Then, a scan of the print head is executed to apply the coloring inks to the area printed with the reacting liquid. Simultaneously, the reacting liquid is applied to an area which precedes by one band the area printed with coloring inks. Then, the coloring inks are applied. Simultaneously, the reacting liquid is applied to the area which precedes by one band the area printed with coloring inks. An image is formed by repeating the above steps.

7 Claims, 5 Drawing Sheets

S : ARRAY OF REACTING LIQUID EJECTING NOZZLES
K C M Y : ARRAYS OF COLORING INK EJECTING NOZZLES

METHOD AND APPARATUS FOR INK JET PRINTING

BACKGROUND OF THE INVENTION

1. Field of the Invention

The present invention relates to a method and apparatus for ink jet printing, and more specifically, to a method and apparatus for ink jet printing which carries out printing by attaching a reacting liquid and coloring inks to a print medium.

2. Description of the Related Art

An ink jet printing system, an electrophotographic system, a thermal head system, and the like have been utilized as a printing system for image printing apparatuses represented by printers. Of these printing systems, the ink jet system can be used to increase the quality of images outputted by the image printing apparatus and to facilitate coloring of images. Further, coloring inks for ink jet printing and print media such as paper are both relatively inexpensive and various print medium types are available. Consequently, image printing apparatuses utilizing such an ink jet printing system are widely utilized at general homes, offices, and the like.

The ink jet printing system causes small droplets of coloring inks for printing to fly and adhere to a print medium. In particular, Japanese Patent Application Publication Nos. 61-059911 (1986), 61-059912 (1986), and 61-059914 (1986) disclose a method of using an electrothermal converter as means for supplying ejection energy. This method thermally changes the state of the coloring inks to eject the inks from ejection ports on the basis of the change in state, thus forming droplets. This method provides a print head with a high-density multi-orifice. Thus, images of high resolution and high quality can be printed at high speed.

However, in general, the coloring inks used for the conventional ink jet printing mainly consist of water and contain a water-soluble high-boiling-point solvent such as glycol in order to prevent drying and clogging. If such coloring inks are used to execute printing on ordinary paper, they permeate through the ordinary paper to hinder a sufficient image density from being achieved. In some cases, the image density becomes ununiform (or non-uniform) expectedly because of the ununiform distributions, on a surface of print paper, of a loading material and a sizing agent contained in the coloring inks. Further, if a color image is to be obtained, coloring inks for multiple colors are sequentially superimposed on one another before being fixed to the print medium. Accordingly, in a boundary portion of images formed by different colors, bleeding may occur in which the colors bleed and are ununiformly mixed together. Then, a satisfactory image cannot be obtained.

As means for correcting the bleeding, a method has been disclosed which attaches a liquid serving to improve an output image from the image printing apparatus (this liquid will hereinafter referred to as a "reacting liquid"), to a print medium before ejection of the coloring inks. Japanese Patent Application Laid-open No. 5-202328 (1993) proposes a method of preventing bleeding utilizing the reaction between polyvalent metal ions and carboxyl groups. Further, Japanese Patent Application Laid-open No. 9-207424 (1997) proposes a method of correcting bleeding using the reaction between a pigment and a resin emulsion and a polyvalent metal salt.

Thus, for the method of ink jet printing in which the reacting liquid is attached to a print medium before the coloring inks, a number of methods for efficiently carrying out printing have been proposed. Japanese Patent Application Laid-open No. 7-195823 (1995) proposes an ink jet printing apparatus in which a reacting liquid ejecting nozzle is placed at a leading end of a print head of a serial printer in a main scanning direction so that the reacting liquid is attached to the surface of a print medium before the coloring inks. However, when this configuration is used for bidirectional printing in order to increase a printing speed, the order in which the reacting liquid and the coloring inks are attached to the print medium is reversed between a forward scan and a backward scan. As a result, ununiformity of colors occurs at each scan of certain forward and backward scanning, thus degrading the quality of the image.

On the other hand, Japanese Patent Application Laid-open No. 2001-138554 proposes an ink jet printing apparatus in which the reacting liquid ejecting nozzles are provided at both ends of the print head in the scanning direction so as to enable high-grade images to be printed at high speed through one-pass bidirectional printing. However, in this apparatus, since the reacting liquid ejecting nozzles are provided at both ends, an additional chip and an additional recovery unit must be provided. This increases costs and complicates the apparatus.

Moreover, Japanese Patent Application Laid-open No. 10-193579 (1998) proposes an inkjet print head characterized in which the reacting liquid ejecting nozzle is placed in front of coloring ink ejecting nozzles in a direction in which the print medium is moved in a paper feeding operation. If this ink jet print head is used to carry out one-pass bidirectional printing, since the reacting liquid ejecting nozzle is disposed in front of the coloring ink ejecting nozzles in the paper feeding direction, the coloring inks impact, during a backward scan, the reacting liquid applied to the print medium during a forward scan. Alternatively, the coloring inks impact, during a forward scan, the reacting liquid applied to the print medium during a backward scan. On this occasion, before dots of the coloring inks ejected during a second scan following a first scan impact dots of the reacting liquid impacting the print medium at a certain point during the first scan, a difference in impacting time occurs which corresponds to the time required by the ink jet print head to move to one end of the print medium and return to the initial point. The difference in impacting time varies, within a band, depending on the position impacted by the reacting liquid. Consequently, even within the same band, the difference in impacting time is large in some parts and small in other parts. Thus, the colors may be ununiform within the band.

If bidirectional printing is carried out using the reacting liquid in order to prevent bleeding caused by the coloring inks as described above, the order in which the reacting liquid and the coloring inks are attached to the print medium is reversed between the forward scan and backward scan of the print head as disclosed in Japanese Patent Application Laid-open No. 7-195823 (1995). As a result, ununiformity of colors occurs at each scan of certain forward and backward scanning, thus degrading the quality of the image. On the other hand, Japanese Patent Application Laid-open No. 2001-138554 solves this problem. However, since this apparatus is provided with the reacting liquid ejecting nozzles at both ends of the print head, an additional chip and an additional recovery unit must be provided. This increases costs and complicates the apparatus.

Japanese Patent Application Laid-open No. 10-193579 (1998) is a configuration which solves the above problem and in which the print head has a reacting liquid nozzle placed upstream in the paper feeding direction and coloring ink ejecting nozzles arranged downstream in the paper feeding direction.

However, according to Japanese Patent Application Laid-open No. 10-193579 (1998), the amount of reacting liquid differs from the amount of the coloring inks reacting within the same band of the print medium depending on the difference between the time at which the reacting liquid impacts the print medium and the time at which the coloring inks impact the print medium. Thus difference in the reacting amount may result in nonuniform colors.

SUMMARY OF THE INVENTION

It is an object of the present invention to provide a method and apparatus for ink jet printing which enables inexpensive printing of high-grade images with the reduced ununiformity of colors.

In the first aspect of the present invention, there is provided a method of ink jet printing for printing a print medium for each band by ejecting coloring inks and a reacting liquid which reacts with the coloring inks from a print head while scanning the print head with respect to the print medium, the print head having arrays of ink ejecting nozzles in which a plurality of nozzles through which the coloring inks are ejected are arranged in a predetermined direction and an array of reacting liquid ejecting nozzles in which a plurality of nozzles through which the reacting liquid is ejected are arranged in the predetermined direction, and conveying the print medium in a direction different from the direction of scan of the print head, the method comprising:

a reacting liquid ejecting step of ejecting the reacting liquid from the print head to a predetermined band on the print medium during a first scan of the print head; and an ink ejecting step of ejecting the coloring inks from the print head to the predetermined band to which the reacting liquid has been ejected, during a second scan of the print head succeeding the first scan; and wherein the reacting liquid ejecting step ejects the reacting liquid to the predetermined band so that a ratio of an amount of reacting liquid impacting a unit area to an amount of coloring inks impacting the unit area is varied depending on a position within the predetermined band in the scanning direction.

In the second aspect of the present invention, there is provided a method of ink jet printing for printing a print medium for each band by ejecting coloring inks and a reacting liquid which reacts with the coloring inks from a print head while scanning the print head with respect to the print medium, the print head having arrays of ink ejecting nozzles in which a plurality of nozzles through which the coloring inks are ejected are arranged in a predetermined direction and an array of reacting liquid ejecting nozzles in which a plurality of nozzles through which the reacting liquid is ejected are arranged in the predetermined direction, the method comprising:

a reacting liquid ejecting step of ejecting the reacting liquid from the print head to a predetermined band on the print medium during a first scan of the print head in a forward direction;

a conveying step of conveying the print medium in a direction different from the direction of scan of the print head by an amount equal to a width of the predetermined band in the conveying direction after the reacting liquid ejecting step; and an ink ejecting step of ejecting the coloring inks from the print head to the predetermined band to which the reacting liquid has been ejected, during a second scan of the print head in a backward direction after the conveying step;

wherein the reacting liquid ejecting step ejects the reacting liquid to the predetermined band so that an area in which a ratio of an amount of reacting liquid impacting a unit area to an amount of coloring inks impacting the unit area is relatively high and an area in which the ratio is relatively low are mixed together within the predetermined band.

In the third aspect of the present invention, there is provided a method of ink jet printing for printing a print medium for each band by executing a step of ejecting coloring inks and a reacting liquid which reacts with the coloring inks from a print head while scanning the print head with respect to the print medium, the print head having arrays of ink ejecting nozzles in which a plurality of nozzles through which the coloring inks are ejected are arranged in a predetermined direction and an array of reacting liquid ejecting nozzles in which a plurality of nozzles through which the reacting liquid is ejected are arranged in the predetermined direction, and a step of conveying the print medium in a direction different from the direction of scan of the print head, the method comprising:

an ejection control step of ejecting one of the coloring inks and the reacting liquid from the print head to a predetermined band on the print medium during a first scan of the print head, and ejecting the other of the coloring inks and the reacting liquid from the print head to the predetermined band to which the one of the liquids has been ejected, during a second scan of the print head following the first scan, and wherein the ejection control step ejects the reacting liquid to the predetermined band so that a ratio of an amount of reacting liquid impacting a unit area to an amount of coloring inks impacting the unit area is varied depending on a position within the predetermined band in the scanning direction.

In the fourth aspect of the present invention, there is provided an ink jet printing apparatus for printing a print medium for each band by executing a step of ejecting coloring inks and a reacting liquid which reacts with the coloring inks from a print head while scanning the print head with respect to the print medium, the print head having arrays of ink ejecting nozzles in which a plurality of nozzles through which the coloring inks are ejected are arranged in a predetermined direction and an array of reacting liquid ejecting nozzles in which a plurality of nozzles through which the reacting liquid is ejected are arranged in the predetermined direction, and a step of conveying the print medium in a direction different from the direction of scan of the print head, the apparatus comprising:

an ejection control means for ejecting one of the coloring inks and the reacting liquid from the print head to a predetermined band on the print medium during a first scan of the print head, and ejecting the other of the coloring inks and the reacting liquid from the print head to the predetermined band to which the one of the liquids has been ejected, during a second scan of the print head following the first scan, and wherein the ejection control means ejects the reacting liquid to the predetermined band so that a ratio of an amount of reacting liquid impacting a unit area to an amount of coloring inks impacting the unit area is varied depending on a position within the predetermined band in the scanning direction.

According to an embodiment of the present invention, during the first scan of the print head, the reacting liquid is applied so that the ratio of the amount of reacting liquid impacting a unit area of the print medium to the amount of inks impacting the unit area of the print medium varies depending on the position within the band. Then, during the second scan succeeding the first scan, the coloring inks are applied to the band to which the reacting liquid has been applied. This makes the reacting amount of the liquid reacting comparable to the reacting amount of the coloring inks all over the band. Therefore, the ununiformity of the colors within the band can be reduced.

The above and other objects, effects, features and advantages of the present invention will become more apparent from the following description of embodiments thereof taken in conjunction with the accompanying drawings.

BRIED DESCRIPTION OF THE DRAWINGS

DETAILED DESCRIPTION OF PREFERRED EMBODIMENTS

Embodiments of the present invention will be described below with reference to the drawings.

First Embodiment

Figure 1:
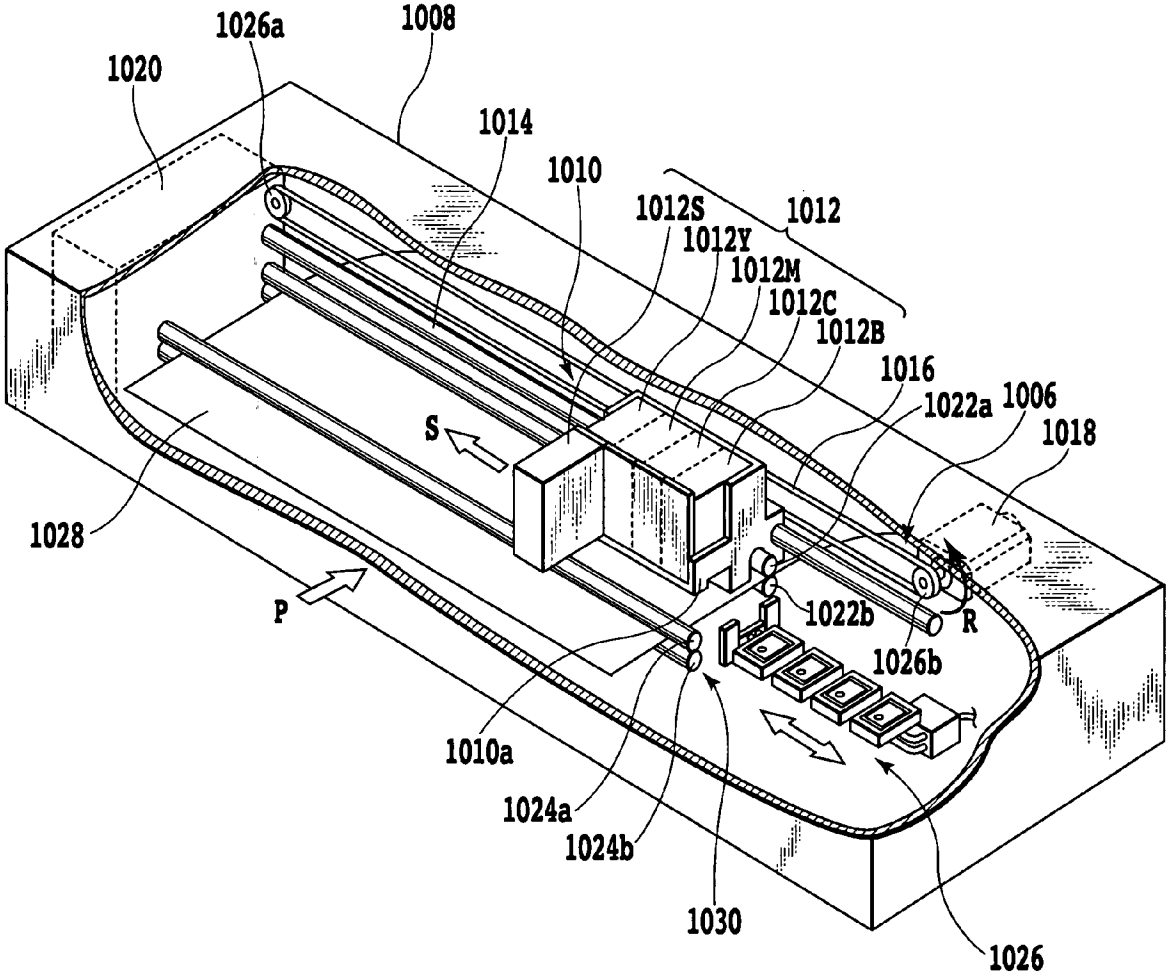
FIG. 1 is a perspective view showing a printing section of an ink jet printing apparatus according to an embodiment of the present invention.

FIG. 1 is a perspective view showing a printing section of an ink jet printing apparatus (hereinafter referred to as an "ink jet printer") according to the present embodiment of the present invention.

In FIG. 1, a guide shaft 1014 is provided along a longitudinal direction of a casing 1008. A printing section 1010 is supported so as to be movable along the guide shaft 1014. A movement driving section 1006 is provided in the casing 1008 to reciprocate a printing section 1010 along the guide shaft 1014 in the casing 1008. Further, a conveying section 1030 is provided in the casing 1008 to convey a print medium 1028 in synchronism with movement of the printing section 1010.

The movement driving section 1006 comprises pulleys 1026*a* and 1026*b*disposed on respective rotating shafts located opposite each other with a predetermined spacing, a belt 1016 wound around the pulleys 1026*a* and 1026*b*, a roller unit 1022*a*, a roller unit 1022*b*, a roller unit 1024*a*, and a roller unit 1024*b*. Further, the movement driving section 1006 comprises a second motor 1020 that drives the roller units and a first motor 1018 that drives a belt 1016 in a forward and backward directions, the belt 1016 being connected to a carriage member 1010*a* placed substantially parallel with the roller units and constituting the printing section 1010.

When the first motor 1018 executes driving, its driving force rotates the belt 1016 in the direction of an arrow R in FIG. 1. As the belt 1016 rotates, the carriage member 1010*a* of the printing section 1010 moves in the direction of an arrow S in FIG. 1 (the forward direction of a main scanning direction) by a predetermined movement amount. Further, when the first motor 1018 rotates in a direction opposite to that in the above description, the belt 1016 is rotated in a direction opposite to that of the arrow R in the figure. As the belt 1016 rotates, the carriage member 1010*a*, constituting the printing section 1010, moves in a direction opposite to that of the arrow S in FIG. 1 (the backward direction of the main scanning direction) by a predetermined movement amount. Thus, the printing section 1010 can reciprocate along the guide shaft 1014 in accordance with rotation of the first motor 1018 to accomplish bidirectional printing. Further, the vicinity of one end of the guide shaft 1014 is a home position of the carriage member 1010*a*. At the home position, a recovery unit 1026 is provided opposite an array of ink ejection ports in the printing section 1010; the recovery unit 1026 executes a process of recovering ejection from the printing section 1010.

Common bidirectional printing is premised on the completion of printing of one scan area by one main scan by the printing section 1010. Each scan area is printed while alternately repeating a forward scan and a backward scan. Between the forward scan and the backward scan, a print medium is conveyed in a sub-scanning direction by an amount equal to the width of the scan area (the length of the printing section).

The printing section 1010 comprises an ink jet cartridge 1012 (hereinafter referred to as a "cartridge") provided for each ink color. The ink jet cartridge for each color is removably mounted on the carriage member 1010*a*. The present embodiment comprises the ink jet cartridges 1012Y, 1012M, 1012C, and 1012B incorporating yellow, magenta, cyan, and black inks, respectively, and the ink jet cartridge 1012S incorporating a reacting liquid. The cartridges 1012Y, 1012M, 1012C, and 1012B are sequentially arranged in the main scanning direction of the carriage member 1010*a*. The cartridge 1012S for the reacting liquid is placed upstream of the carriage member 1010*a* in a direction P (sub-scanning direction) in which the print medium is conveyed; the cartridge 1012S is placed by the side of the cartridges for the respective colors. Further, each cartridge comprises a print head that ejects the corresponding coloring ink or the reacting liquid and an ink tank that stores the corresponding coloring ink or the reacting liquid.

In the present embodiment, the printing section can be composed of, for example, a print head.

In the present embodiment, the ink colors constituting the ink jet cartridge are yellow, magenta, cyan, and black. However, the ink colors may include a hue other than yellow, magenta, cyan, and black, for example, flesh color or red. Alternatively, these colors may be combined together so as to constitute ink jet cartridges. Further, the number of colors constituting the ink jet cartridges is 4. However, the present invention is not limited to this number. The number of inks can be determined as desired.

If the above configuration is used to perform a printing operation, the carriage member 1010*a* is scanned in the S direction (a forward scan). The reacting liquid is ejected from the cartridge 1012S, while the coloring inks are ejected from the cartridges 1012Y, 1012M, 1012C, and 1012B. Ejected droplets impact and adhere to the print medium. Once the carriage 1010*a* moves to one end of the print medium, the print medium is fed in the direction of an arrow P (sub-scanning direction) by a predetermined amount. At this time, the cartridge 1012S for the reacting liquid is located upstream in the paper feeding direction P (this area will hereinafter also be referred to as an "upstream side") compared to the ink cartridges 1012Y, M, C, and B. Accordingly, the cartridge 1012S for the reacting liquid prints an area of the print medium which is located one pass upstream of an area printed by the inks. Then, the carriage member 1010*a* is scanned in a direction opposite to the direction of the arrow S (a backward scan). At this time, the reacting liquid is printed at an area located upstream by an amount equal to one pass. Accordingly, the coloring inks ejected from the cartridges 1012Y, 1012M, 1012C, and 1012B impact the reacting liquid adhering to the print medium by a scan preceding the current scan. Consequently, the reacting liquid printed during the preceding scan reacts, on the print medium, with the coloring inks ejected during the current scan. On the other hand, on this occasion, the reacting liquid ejected from the cartridge 1012S prints a band located one pass upstream of a band impacted by the coloring inks. An image is formed by repeating the above bidirectional printing. The band refers to an area passed by an array of ink ejecting nozzles (or an array of reacting liquid ejecting nozzles) during one scan. Further, the width of the band in the sub-scanning direction is equal to that of the array of ink ejecting nozzles (or the array of reacting liquid ejecting nozzles).

On this occasion, as described in the DESCRIPTION OF THE RELATED ART, before dots of the coloring inks ejected during a second scan following a first scan impact at dots of the reacting liquid impacting the print medium at a certain point during the first scan, a difference in impacting time occurs which corresponds to the time required by the ink jet print head to move to one end of the print medium and return to the initial point. With a large difference in impacting time, most of the reacting liquid permeates through the print medium and fails to react sufficiently with the coloring inks. Accordingly, the insufficient reaction may affect image quality. To reduce the adverse effect of the difference in impacting time, it is desirable to use a reacting liquid that does not permeate well through the print medium according to the present embodiment. However, even if the reacting liquid does not permeate well through the print medium, it is impossible to perfectly prevent the reacting liquid from permeating through the print medium over time. If the adverse effect of the permeation is serious, that is, if a large difference in impacting time hinders the reacting liquid and the coloring inks from reacting sufficiently in certain areas, the amount of reacting liquid applied per unit area may be increased to raise the probability of successful reaction with the coloring inks. However, if the amount of reacting liquid applied per unit area is increased all over a band on the print medium, an excessively large amount of reacting liquid remains on the surface of the print medium in an area with a small difference in impacting time. Thus, a mixture of the reacting liquid and coloring inks may become likely to flow to boundary parts of the image. This may degrade the image. On the other hand, if the amount of reacting liquid applied per unit area is reduced all over a band on the print medium, an excessively small amount of reacting liquid remains on the surface of the print medium in an area with a large difference in impacting time. This hinders the reacting liquid and the coloring inks from reacting sufficiently in certain areas.

Thus, in the present embodiment, the amount of reacting liquid applied per unit area of the print medium is varied depending on the difference between the time at which the reacting liquid impacts the print medium and the time at which the coloring inks impact the print medium. This reduces the adverse effect of the difference in impacting time. In other words, in the present embodiment, the amount of reacting liquid applied per unit area of the print medium is increased as the difference in impacting time between the reacting liquid and the coloring inks is large. This reduces the difference between the reacting amount of reacting liquid and the reacting amount of coloring inks within one band. As a result, an image with the reduced ununiformity of the colors can be formed. In the present embodiment, the amount of reacting liquid applied per unit area of the print medium is equal to the number of dots of the reacting liquid impacting the print medium.

A detailed description will be given below of the configuration of the print head and the method of ink jet printing.

Figure 2:
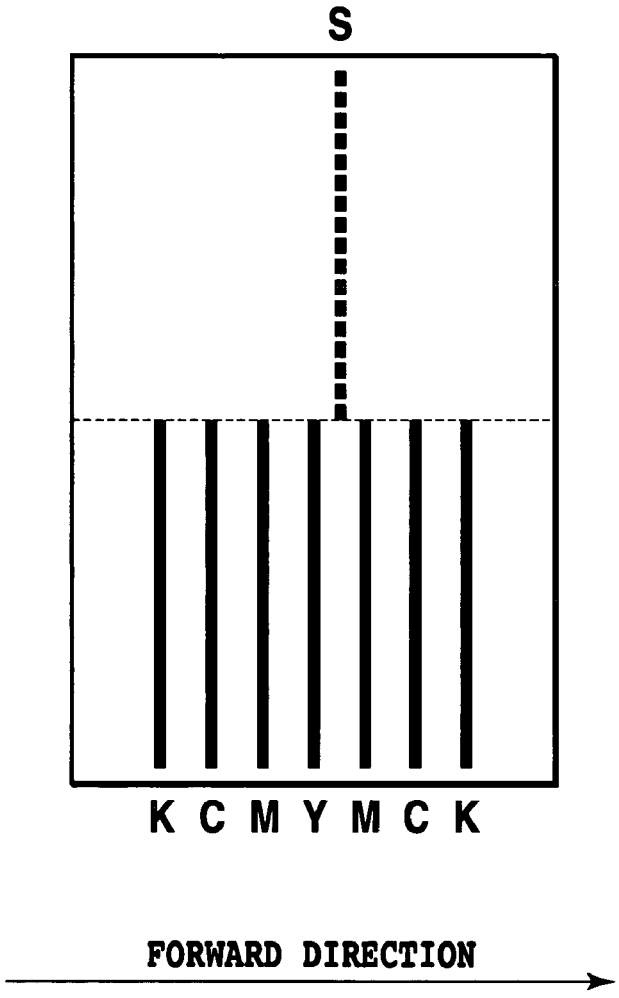
FIG. 2 is a diagram showing a print head according to an embodiment of the present invention.

FIG. 2 is a diagram showing the print head according to the present embodiment. In the figure, K denotes an array of black ink ejecting nozzles, and C denotes an array of cyan ink ejecting nozzles. M denotes an array of magenta ink ejecting nozzles, and Y denotes an array of yellow ink ejecting nozzles. The nozzle arrays are arranged in the order of KCMYMCK in the main scanning direction. This arrangement enables the reacting liquid on the print medium to always react with the coloring inks in the same order. S denotes an array of reacting liquid ejecting nozzles. The array of reacting liquid ejecting nozzles is disposed offset from the arrays of coloring ink nozzles upstream of the print head 1010 in the sub-scanning direction, that is, the direction in which the print medium is conveyed. More specifically, the arrays are arranged so that during one scan of the print head, the array of reacting liquid ejecting nozzles and the arrays of ink ejecting nozzles print different bands. That is, the array of reacting liquid ejecting nozzles and the arrays of ink ejecting nozzles are arranged along the direction in which the nozzles are arranged (sub-scanning direction).

Each nozzle array comprises the ink tank (not shown). Each ink tank stores the corresponding coloring ink or the reacting liquid. Moreover, each ink tank comprises a heater (not shown) including a heating element. Thermal energy generated by the heater causes each coloring ink or the reacting liquid to be ejected through the corresponding nozzles. The above configuration of the print head 1010 allows a certain scan of the print head 1010 to attach the reacting liquid to a certain band of the print medium. Then, during the next scan, the coloring inks can be attached to the reacting liquid on the band.

In the present embodiment, the arrays of coloring ink nozzles may be arranged in any order provided that the arrays are laterally symmetric.

Further, in the present embodiment, the position of the array S of reacting liquid ejecting nozzles is only an example. The present invention is not limited to this position.

Moreover, the print head according to the present embodiment may comprise a piezoelectric element that deforms in accordance with an applied voltage.

Figure 3:
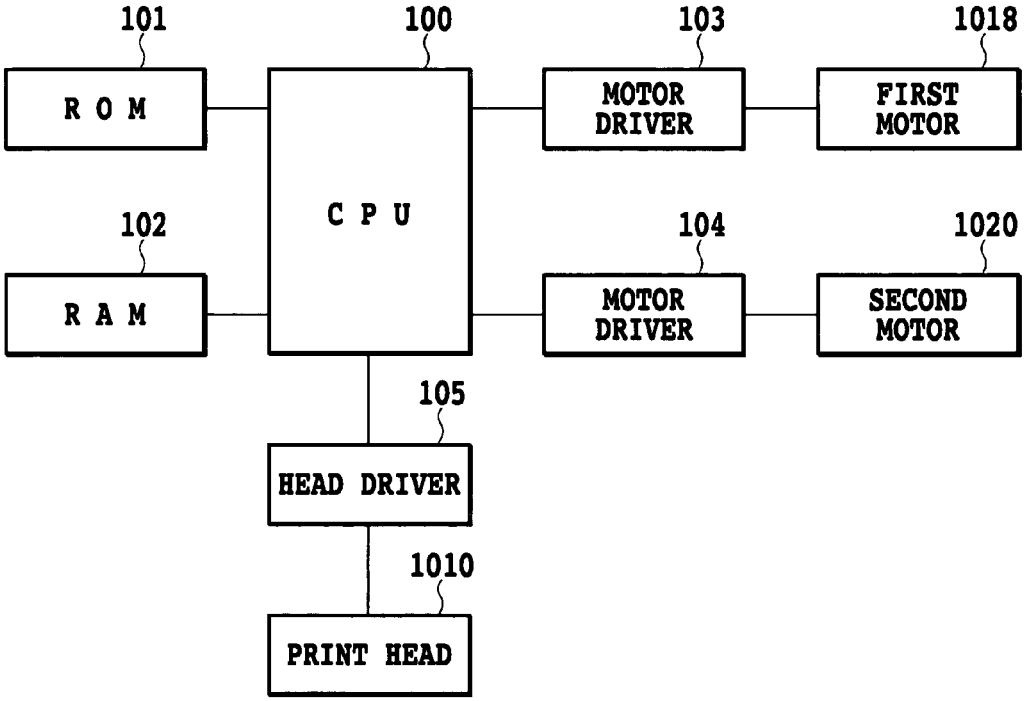
FIG. 3 is a diagram showing a control system for a print head according to an embodiment of the present invention.

FIG. 3 is a schematic block diagram of a control system for the print head according to the present embodiment. In FIG. 3, a CPU 100 executes a process of controlling operations of the present print head, data processing, and the like. A ROM 101 stores programs for a process procedure shown in FIG. 4 and the like. Further, a RAM 102 is used as a work area to execute the processes. The reacting liquid and the coloring inks are ejected from the print head 1010 by the CPU 100 by supplying drive data (image data) and drive control signal (heat pulse signal) to a head driver 105. The CPU 100 controls the first motor 1018 via a motor driver

1103; the first motor 1018 drives the carriage member 1010*a* in the main scanning direction. The CPU 100 controls the second motor 1020 via a motor driver 104; the second motor 1020 conveys the print medium in the sub-scanning direction.

Moreover, the CPU 100 according to the present embodiment constitutes means for executing a thinning process on image data (ink ejection data) used to form an image to create ejection data (hereinafter referred to as "thinning data") on the reacting liquid which varies the ratio of the number of reacting liquid dots impacting a unit area of the print medium to the number of ink dots impacting the unit area. The thinning data is created by executing a mask process with a predetermined thinning rate on the ink ejection data. That is, the reacting liquid ejection data (thinning data) is generated by thinning logical OR data derived from ejection data on the colors C, M, Y, and K. Consequently, in the present embodiment, the reacting liquid is ejected to some of the pixels to which the inks are ejected.

The most characteristic point of the present embodiment is that the thinning rate is varied depending on a position within one scan area (one band) of the print medium as described later in FIG. 4. More specifically, the thinning rate is increased in an area with a relatively small difference in impacting time between the inks and the reacting liquid (that is, an area in one band which is close to the end of a scan of the array of reacting liquid nozzles). In contrast, the thinning rate is reduced in an area with a relatively large difference in impacting time between the inks and the reacting liquid (that is, an area in one band which is close to the start of a scan of the array of reacting liquid nozzles). That is, in an area in which a large amount of reacting liquid remains on the surface of the print medium when the inks come into contact with the reacting liquid, a impacting ratio (a ratio of the number of dots formed on the print medium) of the number of reacting liquid dots (formed on the print medium) to the number of ink dots (formed on the print medium) is reduced. In contrast, in an area in which only a small amount of reacting liquid remains on the surface of the print medium when the inks comes into contact with the reacting liquid, the impacting ratio of the number of reacting liquid dots to the number of ink dots is increased. Therefore, the amount of inks reacting can be made substantially comparable to the amount of reacting liquid reacting in any area within one band.

Figure 4:
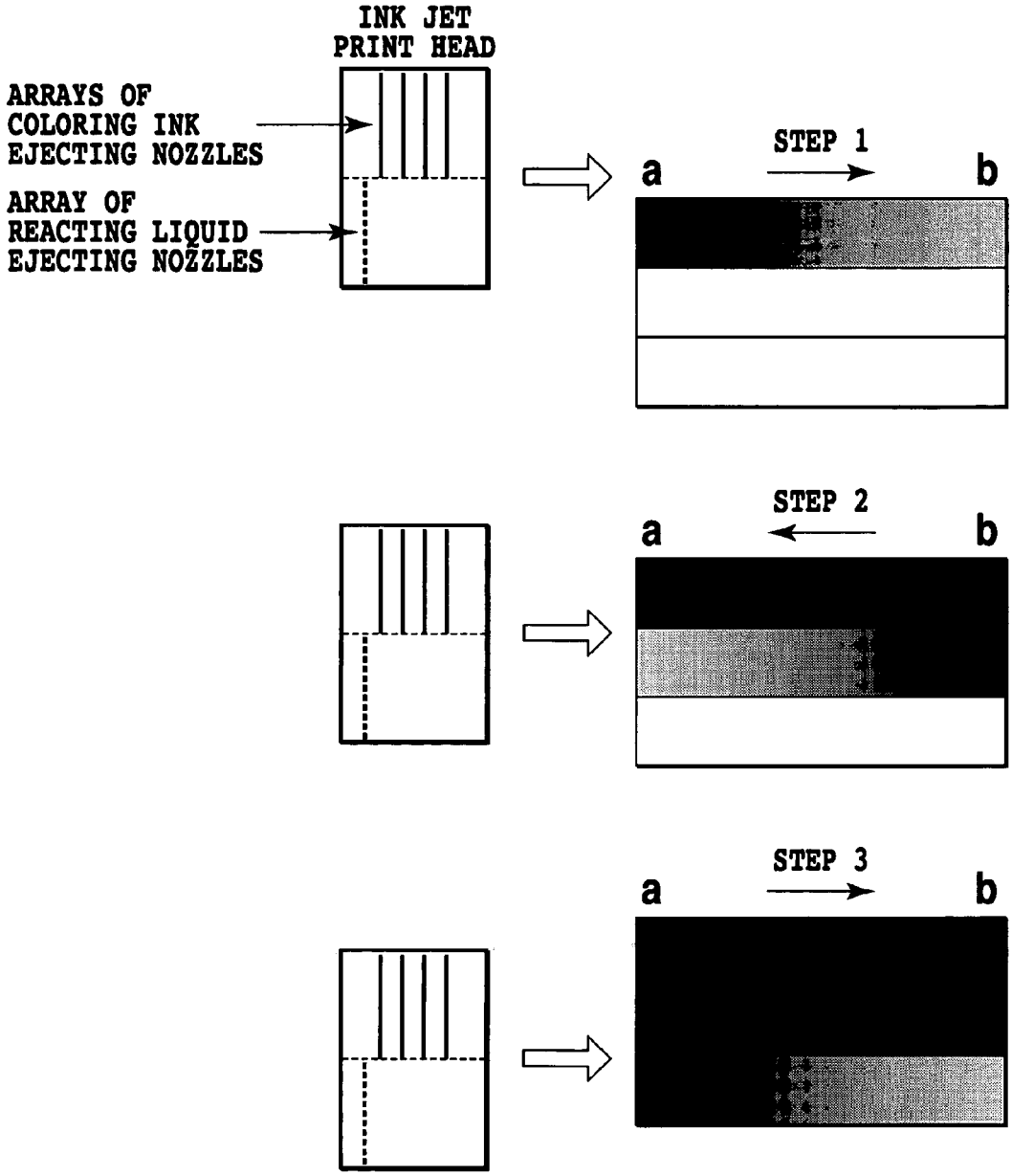
FIG. 4 is a diagram showing a method of ink jet printing based on bidirectional printing according to an embodiment of the present invention.

FIG. 4 is a diagram showing the method of ink jet printing based on bidirectional printing according to the present embodiment. In this figure, black parts represent the coloring inks adhering to the print medium. Gray gradated parts represent the reacting liquid adhering to the print medium. A darker gradated color indicates a larger value for the number of reacting liquid dots impacting the unit area of the print medium. Further, the direction from a to b in the figure corresponds to the main scanning forward direction. The direction from b to a corresponds to the main scanning backward direction.

As is apparent from the figure, in this case, the coloring inks are printed in a print rate of 100% (what is called solid printing). The print rate for the coloring inks is the same (100%) all over one band. On the other hand, the print rate for the reacting liquid is varied depending on the position within one band. Specifically, the print rate is high in an area within one band which is close to the start of a scan of the array of reacting liquid nozzles and is low in an area within one band which is close to the end of the scan.

The print rate refers to the number of actual print dots divided by the number of positions per a unit area that can be impacted by print dots. Accordingly, the print rate of 100% means that the print dots actually impact all the positions that can be impacted by print dots.

With references to steps 1 to 3 in FIG. 4, a detailed description will be given of the method of ink jet printing according to the present embodiment.

Step 1

The reacting liquid is applied to the print medium during a forward scan by scanning the print head 1010. At this time, the reacting liquid is applied to the print medium by gradually reducing the number of reacting liquid dots impacting the unit area of the print medium as the scan moves from a point where printing of the reacting liquid is started (a in FIG. 4) to a point where the printing is ended (b in FIG. 4), on the basis of the thinning data created by the CPU 100, for example, increasing the thinning rate in one scan area (one band) at a fixed rate. Further, in the present step (start of image formation), the coloring inks are not ejected.

Step 2

When the print head 1010 moves to b in FIG. 4 in the step 1, the print head 1010, in the present step, is scanned in the backward direction to apply the coloring inks to the reacting liquid applied to the print medium in the step 1. At the same time, the reacting liquid is applied to an area which precedes by one band the area in which the coloring inks are printed. At this time, the reacting liquid is applied to the print medium by gradually reducing the number of reacting liquid dots impacting the unit area of the print area as the scan moves from the point where printing of the reacting liquid is started (b in FIG. 4) to the point where the printing is ended (a in FIG. 4), on the basis of the thinning data created by the CPU 100.

Step 3

When the print head 1010 moves to a in FIG. 4 in the step 2, the print head 1010, in the present step, is scanned in the forward direction to apply the coloring inks to the reacting liquid applied to the print medium in the step 2. At the same time, the reacting liquid is applied to an area which precedes by one band the area in which the coloring inks are printed. At this time, the reacting liquid is applied to the print medium by gradually reducing the number of reacting liquid dots impacting the unit area of the print medium as the scan moves from the point where printing of the reacting liquid is started (a in FIG. 4) to the point where the printing is ended (b in FIG. 4), on the basis of the thinning data created by the CPU 100.

An image is formed by repeating the steps 1 to 3. However, during the scan at the end of the image formation, the reacting liquid is not applied to the print medium.

In the present embodiment, the thinning rate in one scan area (one band) is increased at a fixed rate from an area in the band which is close to the start of the scan to an area of the band which is close to the end of the scan. In other words, the thinning rate is linearly increased. However, the present invention is not limited to this aspect. The thinning rate can be determined in accordance with the absorptivity of the reacting liquid to the print medium.

As described above, according to the present embodiment, in the step 1, the reacting liquid is applied so as to reduce the number of reacting liquid dots impacting the unit area of the print medium as the scan moves from the first area corresponding to the point within one band where printing of the reacting liquid is started (a in FIG. 4) to the second area corresponding to the print end point (b in FIG. 4), on the basis of the reacting liquid ejection data (thinning data) created by the CPU 100 and corresponding to the band. In this case, in the step 2, when the coloring inks are applied to the band in which the reacting liquid was applied in the step 1, the number of reacting liquid dots impacting the unit area of the print medium is larger in the first area, in which there is a larger difference in impacting time between the reacting liquid and the coloring inks. This avoids the adverse effect of permeation caused by the difference of the time when the reacting liquid impacts the print medium. It is thus possible to allow the reacting liquid and the coloring inks to react sufficiently. On the other hand, the number of reacting liquid dots impacting the unit area of the print medium is smaller in the second area, in which there is a smaller difference in impacting time between the reacting liquid and the coloring inks. This avoids, for example, bleeding caused by an excessive amount of reacting liquid. It is thus possible to allow the reacting liquid and the coloring inks to react favorably. Further, the number of reacting liquid dots impacting the unit area of the print medium is varied depending on the difference in impacting time between the reacting liquid and the coloring inks. This allows the reacting liquid and the coloring inks to react successfully even in the area between the first and second areas. Therefore, a high-quality image with the reduced ununiformity of the colors can be obtained within the band on the print medium scanned by the print head 1010. Moreover, repeating the above steps enables a high-quality image with the reduced ununiformity of the colors to be obtained all over the print medium through bidirectional printing.

In the example of the present embodiment, the coloring inks are printed at a print rate of 100% (what is called solid printing). Accordingly, in the description of the present embodiment, the amount of reacting liquid applied per unit area is gradually reduced as the scan moves within one band from the vicinity of the scan start point to the vicinity of the scan end point. However, many actually printed images have an area with a high coloring ink print rate and an area with a low coloring ink print rate mixed within one band rather than being solidly printed. For example, some images have a low print rate in an area of one band which is close to the start of the scan and a high print rate in an area of the band which is close to the end of the scan. For such an image, to make the amount of inks reacting the same as that of reacting liquid reacting in the area close to the start of the scan and the area close to the end of the scan, the thinning rate for the reacting liquid is reduced in the area close to the start of the scan, while the thinning rate is increased in the area close to the end of the scan, as described above. Even with such a varying thinning rate, the absolute amount of reacting liquid applied per unit area may be larger in the area close to the end of the scan with the higher thinning rate than in area close to the start of the scan with the lower thinning rate. This is due to the generation of the reacting liquid ejection data based on the ink ejection data.

Accordingly, in the present embodiment, it is not essential to vary the amount of reacting liquid applied per unit area depending on the position within one band. It is important to vary the thinning rate for the reacting liquid depending on the position within one band. That is, the essence of the present embodiment is to minimize the difference in the reaction amount between the inks and the reacting liquid within one band by varying the impacting ratio of the number of reacting liquid dots impacting the unit area of the print medium to the number of ink dots impacting the unit area of the print medium depending on the position within the band. Thus, in a first of such embodiments, reacting liquid ejection data is created in which the ratio of the amount of reacting liquid impacting the unit area of the print medium to the amount of ink impacting the unit area of the print medium is varied depending on the position within one band. On the basis of the reacting liquid ejection data, a first scan of the print head is executed to apply the reacting liquid to a predetermined band on the print medium. A second scan of the print head following the first scan is then executed to print the coloring inks on the predetermined band to which the reacting liquid has been applied. By thus printing each band, it is possible to make the amount of reacting liquid reacting comparable to the amount of coloring inks reacting all over the band to reduce the ununiformity of the colors within the band.

Now, description will be given of the reacting liquid according to the present invention.

A polyvalent metal salt is the most suitable reaction agent contained in the reacting liquid according to the present embodiment and which reacts the coloring pigment inks. The polyvalent metal salt is composed of polyvalent metal ions of bivalence or more and negative ions bound to the polyvalent metal ions. Specific examples of the polyvalent metal ions are bivalent metal ions such as $Ca^{2+}$, $Cu^{2+}$, $Ni^{2+}$, $Mg^{2+}$, and $Zn^{2+}$ and trivalent metal ions such as $Fe^{3+}$ and $Al^{3+}$. The negative ions include $Cl^{3-}$, $NO^{3-}$, $SO^{4-}$, and the like. To allow the reacting liquid to react instantaneously with the coloring pigment inks to form a cohesive film, it is desirable that the total concentration of charges of the polyvalent metal ions in the reacting liquid is twice or more as large as that of negative polarity ions in the coloring pigment inks.

Water-soluble organic solvents that can be used in the reacting liquid according to the present embodiment include, for example, amides such as dimethylformamide and dimethylacetamides; ketones such as acetones; ethers such as tetrahydrofuran and dioxane; polylakylene glycols such as poyethylene glycol and polypropylele glycol; alkylene glycols such as ethylene glycol, propylene glycol, butylene glycol, triethylene glycol, 1,2,6-hexanetriol, thiodiglycol, hexylene glycol, and diethylene glycol; lower alkyl ethers of polyalcohols such as ethylene glycol methyl ether, diethylene glycol monomethyl ether, triethylene glycol monomethyl ether; monohydroxy alcohols such as ethyl alcohol, isopropyl alcohol, n-butyl alcohol, and isobutyl alcohol, and other solvents such as glycerin, N-methyl-2-pyrrolidone, 1,3-dimetyl-2-imidazolidinone, triethanolamine, sulfolane, and dimethyl sulfoxide. In the present embodiment, the content of the above water-soluble organic solvent in the reacting liquid is not particularly limited. However, a suitable range is 5 to 60 wt %, more preferably 5 to 40 wt % of the total weight of the reacting liquid.

Further, an additive such as a viscosity modifier, a pH modifier, a preservative, or an antioxidant may be appropriately mixed into the reacting liquid according to the present embodiment. However, attention must be paid to the selection and additive amount of a surface active agent functioning as a permeation promoter in connection with the suppression of permeation of the reacting liquid through the print medium. Moreover, the reacting liquid according to the present invention is more preferably colorless. However, the reacting liquid may have a light color such that when mixed with the inks on the print medium, the reacting liquid does not change the tones of the color inks. Furthermore, as the suitable range of physical properties of the reacting liquid according to the present embodiment, the viscosity is preferably adjusted to between 1 to 30 cps. at about 25° C.

Now, description will be given of the coloring pigment inks according to the present embodiment.

The pigment in each coloring pigment ink used in the present embodiment is at 1 to 20 wt %, preferably 2 to 12 wt % of the total weight of the coloring pigment ink. Of the pigments used in the present embodiment, the black pigment may specifically be carbon black. The carbon black is manufactured by a furnace process or a channel process and preferably has a primary grain size of 15 to 40 mμ (nm), a BET-process-based specific surface area of 50 to 300 $m^2/g$, a DBP oil absorption of 40 to 150 ml/100 g, a volatile matter content of 0.5 to 10%, and a pH value of 2 to 9. Preferable commercially available carbon blacks having such characteristics include, for example, No. 2300, No. 900, MCF88, No. 33, No. 40, No. 45, No. 52, MA7, MA8, and No. 2200B (manufactured by MITSUBISHI CHEMICAL CORPORATION), RAVEN1255 (manufactured by Columbia), REGAL400R, REGAL330R, REGAL660R, and MOGUL L (manufactured by Cabbot), Color Black FW1, COLOR Black FW18, Color Black S170, Color Black S150, Printex 35, and Printex U (manufactured by Degussa).

The yellow pigment includes, for example, C. I. Pigment Yellow 1, C. I. Pigment Yellow 2, C. I. Pigment Yellow 3, C. I. Pigment Yellow 13, C. I. Pigment Yellow 16, or C. I. Pigment Yellow 83. The magenta pigment includes, for example, C. I. Pigment Red 5, C. I. Pigment Red 7, C. I. Pigment Red 12, C. I. Pigment Red 48 (Ca), C. I. Pigment Red 48 (Mn), C. I. Pigment Red 57 (Ca), C. I. Pigment Red 112, or C. I. Pigment Red 122. The cyan pigment includes, for example, C. I. Pigment Blue 1, C. I. Pigment Blue 2, C. I. Pigment Blue 3, C. I. Pigment Blue 15:3, C. I. Pigment Blue 16, C. I. Pigment Blue 22, C. I. Vat Blue 4, or C. I. Vat Blue 6. Of course, the present embodiment is not limited to this aspect. Besides, newly manufactured pigment such as a self-dispersion pigment can of course be used.

Further, any dispersant for the pigments may be used provided that it is composed of a water-soluble resin. However, the dispersant preferably has a weighted mean molecular weight of 1,000 to 30,000, more preferably 3,000 to 15,000. Specifically, such a dispersant includes a block coplymer, a random coplymer, a graft copolymer, or their salts consisting of at least two monomers (at least one of them is a hydrophilic polymeric monomer) selected from a group of stylene and its derivatives, vinylnaphthalene and its derivatives, aliphatic alcohol esters of ethylene, a, B-unsaturated carboxylic acid, acrylic acid and its derivatives, maleic acid and its derivatives, itaconic acid and its derivatives, fumaric acid and its derivatives, vinyl acetate, vinyl pyrrolidone, and acrylamide and its derivatives. Moreover, a natural resin such as rosin, shellack, or starch can preferably be used. These resins are soluble to a water solution into which bases are dissolved and are soluble to alkali. The water-soluble resin used as a pigment dispersant is preferably contained in the coloring pigment ink so that its content is 0.1 to 5 wt % of the total weight of the coloring pigment ink.

In particular, if the coloring pigment inks contain the above pigments, they are preferably entirely adjusted to be neutral or alkalic. Preferably, such coloring pigment inks improve the solubility of the water-soluble resin used as a pigment dispersant and can be stored for an increased period of time. However, in this case, the inks may corrode various members of the ink jet printing apparatus and thus preferably have a pH range of 7 to 10. pH modifiers that can be used in this case include organic amines such as diethanol amine and its triethanol amine; inorganic alkaline chemicals like alkaline hydroxide such as sodium hydrocide, lithium hydroxide, and potassium hydroxide; organic acids; and mineral acids. The above pigments and the water-soluble resin as a dispersant are dispersed or dissolved into an aqueous liquid medium.

A mixed solvent of water and a water-soluble organic solvent is an aqueous liquid medium suitable for the coloring pigment inks containing the pigments used in the present embodiment. The water is not common water containing various ions but is preferably ion-exchanged water (deionized water).

Preferable water-soluble organic solvents mixed with water include alkyl alcohols with carbon number 1–4 such as methyl alcohol, ethyl alcohol, n-propyl alcohol, isopropyl alcohol, n-butyl alcohol, sec-butyl alcohol, and tert-butyl alcohol; amides such as dimethylformamide and dimethylacetamide; ketones or ketoalcohols such as acetone and diacetone alcohol; ethers such as tetrahydrofuran and dioxane; polyakylene glycols such as polyethylene glycol and polypropylene glycol; alkylene glycols with alkylene groups having 2–6 carbon atoms such as ethylene glycol, propylene glycol, butylene glycol, triethylene glycol, 1,2,6-hexanetriol, thiodiglycol, hexylene glycol, and diethylene glycol; glycerin; lower alkyl ethers of polyalcohols such as ethylene glycol monomethyl (or ethyl) ether, diethylene glycol methyl (or ethyl) ether, triethylene glycol monomethyl (or ethyl) ether; and N-methyl-2-pyrrolidone, 2-pyrrolidonne, and 1,3-dimethyl-2-imidazolidinone.

The content of the water-soluble organic solvent in the coloring pigment ink is generally 3 to 50 wt %, more preferably 30 to 40 wt % of the total weight of the coloring pigment ink. Further, the content of water used is generally 10 to 90 wt %, more preferably 30 to 80 wt % of the total weight of the coloring pigment ink.

Further, a surface active agent, an antifoaming agent, or a preservative can be appropriately added to the coloring pigment inks according to the present embodiment so that the inks have desired physical values as required. In particular, the surface active agent, functioning as a permeation promoter, serves to allow the reacting liquid and the coloring pigment inks to permeate quickly through the print medium. Accordingly, an appropriate amount of surface active agent must be added to the coloring pigment inks. The suitable amount of surface active agent added is 0.01 to 10 wt %, preferably 0.5 to 5 wt %. As an anionic surface active agent, any common carboxylate type, nitric ester type, sulfonate type, or phosphate type can preferably be used.

To produce a coloring pigment ink containing the above pigment, the pigment is first added to an aqueous medium containing at least a water-soluble resin as a dispersant and water. Then, these liquids are mixed together and agitated and the mixture is then dispersed using dispersing means (described later) and is subjected to a centrifugal separation process as required to obtain a desired dispersed liquid. Then, a sizing agent and appropriately selected additive components listed above are added to the dispersed liquid. The dispersant is then agitated to obtain a coloring pigment ink used in the present embodiment.

If the above alkali-soluble resin is used as a dispersant, bases must be added to the resin in order to dissolve it. The preferable bases are organic amines such as monoethanol amine, diethanol amine, triethanol amine, amine methyl propanol, and ammonia or inorganic bases such as potassium hydroxide and sodium hydroxide.

To produce a coloring pigment ink containing the pigment, it is effective to carry out premixing for 30 minutes or more before agitating and dispersing an aqueous medium containing the pigment. That is, such a premixing operation preferably improves the wettability of the surface of the pigment to facilitate the adsorption of the dispersant to the surface of the pigment.

Any common disperser may be used to disperse the above pigments. Dispersers that can be used in the present embodiment include, for example, a ball mill, a roll mill, and a sand mill. Among these dispersers, a very fast sand mill is preferable. Examples of the very fast sand mill include Super Mill, Sand Grinder, Beads Mill, Agitator Mill, Grain Mill, Dinoh Mill, Par Mill, and Cobol Mill (all of which are trade names).

Further, according to the method of ink jet printing, the pigment contained in the coloring pigment ink has an optimum grain size distribution owing to the necessity for clogging resistance. Methods for obtaining a pigment having such a desired grain size distribution include reducing the size of a grinding medium in the disperser, increasing a filling factor for the grinding medium, increasing a treatment time, reducing an ejection speed, using a filter or a centrifugal separator to carry out classification after grinding, and a combination of these techniques.

Now, description will be given of examples and comparative examples using the above reacting liquid and coloring inks.

EXAMPLE 1

In the description below, parts (pts) and % denote weight criteria unless otherwise specified.

The coloring inks (black, cyan, magenta, and yellow) used in the present embodiment and each containing the pigment and anionic compound are obtained as follows. The case of the black ink will be described below by way of example.

(Coloring Pigment Ink)

<Production of Pigment Dispersed Liquid>

Copolymer of stylene, acrylic acid, and ethyl acrylate (acid value: 240 and weighted mean molecular weight: 5,000): 1.5 pts Monoethanol amine: 1.0 pts Diethylene glycol: 5.0 pts Ion exchanged water: 81.5 pts.

These components were heated in a water bath to 70° C. to completely dissolve the resin. Then, 10 pts of newly experimentally produced carbon black (MCF88 manufactured by MITSUBISHI CHEMICAL CORPORATION) and 1 pts of propylalcohol were added to the solution. The solution was then premixed for 30 minutes and dispersed under the following conditions:

Disperser: Sand grinder (manufactured by Igarashi Machinery)

Grinding medium: Zirconium beads of diameter 1 mm

Filling factor for grinding medium: 50% (volumetric ratio)

Grinding time: 3 hours.

Moreover, a centrifugal separation process (12,000 rpm, 20 minutes) was executed and bulky grains were removed to obtain a pigment dispersed liquid.

<Production of Coloring Pigment Ink K (Black Coloring Ink)>

Components having the composition ratio shown below were mixed into the above dispersed liquid to obtain an ink containing the pigment, that is, a coloring pigment ink. The ink had a surface tension of 34 mN/m.

Composition Ratio of Coloring Pigment Ink K

Above pigment dispersed liquid: 30.0 pts

Glycerin: 10.0 pts

Ethylene glycol: 5.0 pts

N-methylpyrrolidone: 5.0 pts

Ethyl alcohol: 2.0 pts

Acethylenol EH (manufactured by Kawaken Fine Chemical): 1.0 pts

Ion exchanged water: 47.0 pts.

(Reacting Liquid)

Then, the components shown below were mixed and dissolved into the solution. The solution was then filtered under pressure using a membrane filter (trade name: Floro Pore Filter; manufactured by Sumitomo Electric Industries, Ltd.) having a pore size of 0.22 μm. Thus, a resting liquid having pH adjusted to 3.8 was obtained.

<Composition of Reacting Liquid>

Diethylene glycol: 10.0 pts

Methyl alcohol: 5.0 pts

Magnesium nitrate: 3.0 pts

Acetylenol EH (manufactured by Kawaken Fine Chemical)

Ion exchanged water: 81.9 pts.

Then, with the method of ink jet printing according to the present embodiment, described above, print matter was created by using the thus produced coloring pigment ink K and reacting liquid and an ink jet print head having a nozzle array configuration such as the one shown in FIG. 2 to bidirectionally print a black solid image patch.

Figure 5:
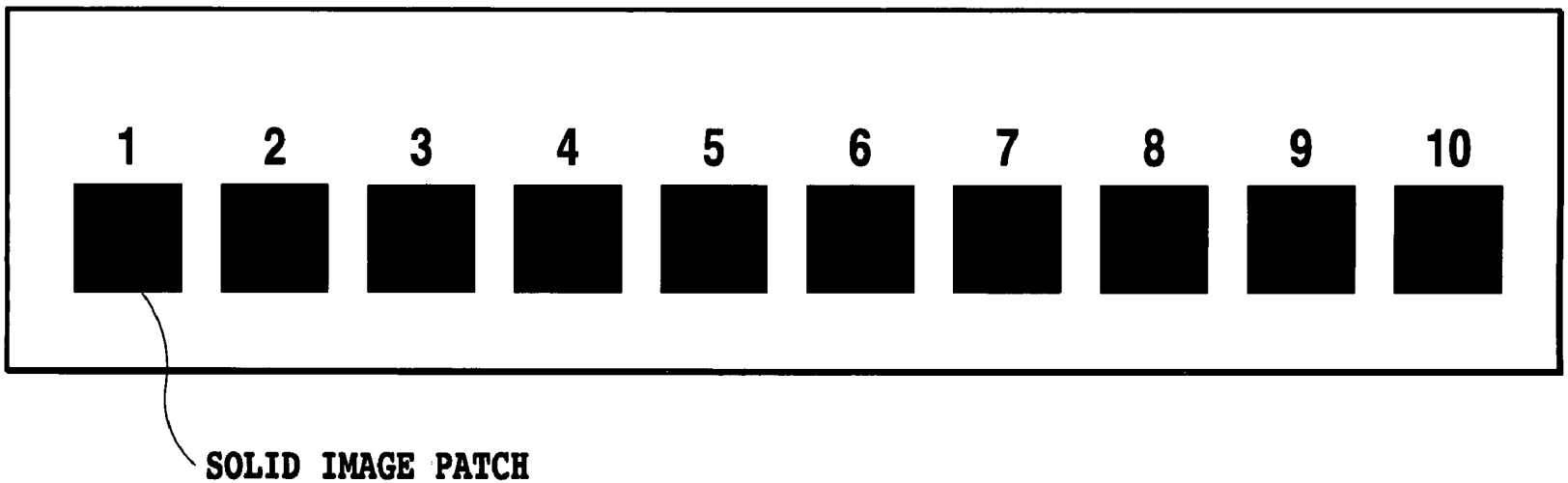
FIG. 5 is a diagram showing black solid image patches according to an example of the present invention.

FIG. 5 is a diagram showing black solid image patches according to the example of the present invention. In this figure, reference numerals 1 to 10 denote solid image patches corresponding to the varying amount of reacting liquid applied per unit area of the print medium.

However, the length of a side of each solid image patch is smaller than the print width of an area printed with the reacting Liquid and coloring inks. The print head used had a print density of 1,200 dpi and used a driving frequency of 15 MHz as its driving condition. Further, the head ejected 4 pl per dot. Environmental conditions for print tests were 25° C. and 55% RH. The rate of reacting liquid dots printed per unit area of the print medium was set at 50% when a patch was printed which was located at the position corresponding to the start of printing within a band of the print medium (a solid image patch 1 at the left end of FIG. 5). The rate of reacting liquid dots printed per unit area of the print medium was gradually reduced as the difference in impacting time between the reacting liquid and the coloring inks was small. The rate was 25% when a patch was printed which is located at the position corresponding to the end of printing within the band of the print medium (a solid image patch 10 at the right end of FIG. 5).

When a solid black image was printed according to the present example, a favorable image free from the ununiformity of the color was obtained even with a variation in the rate of reacting liquid dots printed per unit area of the print medium as shown in the solid image patches 1 to 10 in FIG. 5.

EXAMPLE 2

In the present example, the rate of reacting liquid dots printed per unit area of the print medium was set at 40% for the patch located at the position corresponding to the start of printing within a band of the print medium. The rate of reacting liquid dots printed per unit area of the print medium was gradually reduced as the difference in impacting time between the reacting liquid and the coloring inks was small. The rate was 25% when the patch was printed which was located at the position corresponding to the end of printing within the band of the print medium. Other conditions were all same as Example 1.

Then, the print matter created according to Examples 1 and 2 was evaluated using the evaluation method and criterion described below. The results are shown below.

After printing was carried out according to Examples 1 and 2, the reflection densities of the black solid image patches were measured using a reflection densimeter RD-19I (manufactured by Gretag Macbeth). The results are shown in Table 1.

TABLE 1

| Patch NO | 1 | 2 | 3 | 4 | 5 | 6 | 7 | 8 | 9 | 10 |
|---|---|---|---|---|---|---|---|---|---|---|
| Example 1 | 1.4 | 1.4 | 1.4 | 1.4 | 1.4 | 1.4 | 1.4 | 1.4 | 1.39 | 1.39 |
| Example 2 | 1.4 | 1.4 | 1.4 | 1.4 | 1.4 | 1.4 | 1.4 | 1.39 | 1.39 | 1.39 |

As described above, in both Examples 1 and 2, the rate of reacting liquid dots printed per unit area of the print medium (the number of reacting liquid impacting the print medium) was varied. Then, within the same band of the print medium, the solid image patches 1 to 10 had almost the same reflection density. As a result, an image with the reduced ununiformity of colors was able to be formed.

Second Embodiment

In the present embodiment, the diameter of dots of the reacting liquid from the print head is varied depending on the difference between the time when the reacting liquid impacts the print medium and the time when the coloring inks impact the print medium. This reduces the adverse effect of the difference in impacting time on image formation. In the present embodiment, attention is paid to the fact that the amount of reacting liquid remaining on the surface of the printing medium decreases as the difference between the time when the reacting liquid impacts the print medium and the time when the coloring inks impact the print medium increases. Specifically, in the present embodiment, the diameter of dots of the reacting liquid applied to the print medium is increased as the difference in impacting time is larage. The diameter of reacting liquid dots can be varied by varying the amount of an ejected droplet of the reacting liquid (the volume per one ejection). In other words, in the present embodiment, the amount of reacting liquid applied per unit area is varied by varying the diameter of dots of the reacting liquid.

In the ink jet printing apparatus according to the present embodiment, the configuration of the printing section, the configuration of the print head, and the configuration of the control system for the print head are similar to those in the first embodiment. Accordingly, in the present embodiment, the configurations carry the same reference numerals and their description is omitted. Only parts characteristic of the present embodiment will be described.

In the present embodiment, a drive signal for the heaters provided in the print head 1010 is a double pulse consisting of a prepulse and a main pulse. The double pulse is used to eject the reacting liquid or the coloring inks. The prepulse mainly serves to provide thermal energy to the inks in the nozzles to the degree that the inks do not bubble, to control the temperature of the inks. The main pulse serves to bubble the inks in the nozzles to eject the inks through the nozzles.

The double pulse is controlled by the CPU 100, shown in FIG. 3. Specifically, the CPU 100 controls, for example, the width of the prepulse of the double pulse to vary the amount of reacting liquid ejected per droplet and thus the diameter of dots of the reacting liquid. The amount of one ejected droplet of the reacting liquid (the volume per one ejection) can also be varied by controlling the interval time between the prepulse and the main pulse. Alternatively, the amount of one ejected droplet of the reacting liquid can be varied by switching from the double pulse to a single pulse.

In the present embodiment, the ejection data on the reacting liquid is created on the basis of the ink ejection data as in the case of the first embodiment. However, unlike the first embodiment, the present embodiment is configured so that the ink ejection data is not thinned but the reacting liquid is ejected to pixels to which the inks are ejected. Then, as described later in FIG. 4, the diameter of dots of the reacting liquid is varied depending on the position within one scan area (one band).

With reference to FIG. 4, description will be given of a method of ink jet printing based on bidirectional printing according to the present embodiment. In the present embodiment, black parts in FIG. 4 represent the coloring inks adhering to the print medium. Gray gradated parts represent the reacting liquid adhering to the print medium. A darker gradated color indicates a larger value for the diameter of reacting liquid dots adhering to the print medium, that is, a larger value for the amount of one ejected droplet of the reacting liquid (the volume per one ejection). Further, the direction from a to b in the figure corresponds to the main scanning forward direction. The direction from b to a corresponds to the main scanning backward direction. With references to steps 1 to 3 in FIG. 4, a detailed description will be given of the method of ink jet printing according to the present embodiment.

Step 1

The reacting liquid is applied to the print medium during a forward scan by scanning the print head 1010. At this time, the reacting liquid is applied to the print medium by gradually reducing the amount of one ejected droplet of the reacting liquid (the volume per one ejection) as the scan moves from a point where printing of the reacting liquid is started (a in FIG. 4) to a point where the printing is ended (b in FIG. 4), on the basis of the prepulse width control performed by the CPU 100 to vary the amount of one ejected droplet of the reacting liquid (the volume per one ejection). The reacting liquid, for example, is applied so as to reduce the amount of one ejected droplet of the reacting liquid (the volume per one ejection) in one scan area (one band) at a fixed rate. Further, in the present step (start of image formation), the coloring inks are not ejected.

Step 2

When the print head 1010 moves to b in FIG. 4 in the step 1, the print head 1010, in the present step, applies the coloring inks, during a backward scan of the print head 1010, to the reacting liquid applied to the print medium in the step 1. At the same time, the reacting liquid is applied to an area located one band upstream of the coloring ink printed area in the paper feeding direction. At this time, the reacting liquid is applied to the print medium by gradually reducing the amount of one ejected droplet of the reacting liquid (the volume per one ejection) as the scan moves from the point where printing of the reacting liquid is started (b in FIG. 4) to the point where the printing is ended (a in FIG. 4), on the basis of the prepulse width control performed by the CPU 100 to vary the amount of one ejected droplet of the reacting liquid (the volume per one ejection).

Step 3

When the print head 1010 moves to a in FIG. 4 in the step 2, the print head 1010, in the present step, applies the coloring inks to the reacting liquid applied to the print medium in the step 2. At the same time, the reacting liquid is applied to an area located one band upstream of the coloring ink printed area in the paper feeding direction. At this time, the reacting liquid is applied to the print medium by gradually reducing the amount of one ejected droplet of the reacting liquid (the volume per one ejection) as the scan moves from the point where printing of the reacting liquid is started (a in FIG. 4) to the point where the printing is ended (b in FIG. 4), on the basis of the prepulse width control performed by the CPU 100 to vary the amount of one ejected droplet of the reacting liquid (the volume per one ejection).

An image is formed by repeating the steps 1 to 3. However, during the scan at the end of the image formation, the reacting liquid is not applied to the print medium.

In the present embodiment, the amount of one ejected droplet of the reacting liquid (the volume per one ejection) in the scan area (one band) is reduced at a fixed rate, that is, linearly reduced. However, the present invention is not limited to this aspect. The variation rate can be determined in accordance with the absorptivity of the reacting liquid to the print medium.

As described above, according to the present embodiment, in the step 1, the reacting liquid is applied so as to reduce the amount of one ejected droplet of the reacting liquid (the volume per one ejection) as the scan moves from the first area corresponding to the point within one band where printing of the reacting liquid is started (a in FIG. 4) to the second area corresponding to the print end point (b in FIG. 4). In this case, the amount of one ejected droplet of the reacting liquid (the volume per one ejection) is larger in the first area, in which there is a larger difference in impacting time between the reacting liquid and the coloring inks. Consequently, this avoids the adverse effect of permeation caused by the difference of the time when, in the step 2, the coloring inks are applied to the band in which the reacting liquid was applied in the step 1. It is thus possible to allow the reacting liquid and the coloring inks to react sufficiently. On the other hand, the amount of one ejected droplet of the reacting liquid (the volume per one ejection) is smaller in the second area, in which there is a smaller difference in impacting time between the reacting liquid and the coloring inks. This avoids, for example, bleeding caused by an excessive amount of reacting liquid. It is thus possible to allow the reacting liquid and the coloring inks to react favorably. Further, the amount of one ejected droplet of the reacting liquid (the volume per one ejection) is varied depending on the difference in impacting time between the reacting liquid and the coloring inks. This allows the reacting liquid and the coloring inks to react successfully even in the area between the first and second areas. Therefore, a high-quality image with the reduced ununiformity of the colors can be obtained within the band on the print medium scanned by the print head 1010. Moreover, repeating the above steps enables a high-quality image with the reduced ununiformity of the colors to be obtained all over the print medium through bidirectional printing.

Further, in the present embodiment, it is also possible to use a reacting liquid, coloring pigment inks, dispersant for the pigments, and a water-soluble organic solvent, all of which are similar to those in the first embodiment. In the present embodiment, a reacting liquid and coloring inks can be produced in the same manner as used in the first embodiment.

In the present embodiment, like the first embodiment, it is not essential to vary the absolute amount of reacting liquid applied per unit area depending on the position within one band. It is important to vary the diameter of dots of the reacting liquid depending on the position within one band. That is, the essence of the present embodiment is to minimize the difference in the reaction amount between the inks and the reacting liquid within one band by varying the ratio of the amount of reacting liquid dots impacting the unit area of the print medium to the amount of ink dots impacting the unit area of the print medium depending on the position within the band.

Another Embodiment

In the first and second embodiments, the print head is configured so that the reacting liquid nozzles are arranged upstream in the paper feeding direction, while the coloring ink nozzles are arranged downstream in the same direction. When this configuration is used to perform a printing operation, the reacting liquid and then the coloring inks are printed on the print medium (a preceding application process). An embodiment of the present invention is not limited to this aspect. The ink head may be configured so that the coloring ink nozzles are arranged upstream in the paper feeding direction, while the reacting liquid nozzles are arranged downstream in the same direction. In other words, when a printing operation is performed, the coloring inks and then the reacting liquid may be printed on the print medium (a following application process). Also in this case, the ratio of the amount of reacting liquid impacting the unit area of the print medium to the amount of ink impacting the unit area of the print medium (for example, the ratio of the number of reacting liquid dots impacting the print medium to the number of ink dots impacting the print medium or the ratio of the amount of reacting liquid dots ejected per operation to the amount of ink dots ejected per operation) is varied depending on the position within the band. In particular, in this form, as the scan of the reacting liquid nozzles progresses, the amount of reacting liquid impacting the unit area is increased with respect to the amount of ink impacting the unit area. In other words, as the scan progresses, the thinning rate is gradually reduced or the diameter of dots of the reacting liquid is gradually increased.

Further, for the following application process, in contrast to the first and second embodiments, the inks have a lower permeability than the reacting liquid.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

This application claims priority from Japanese Patent Application No. 2003-356292 filed Oct. 16, 2003, which is hereby incorporated by reference herein.

What is claimed is:

1. A method of ink jet printing on a print medium for each band by ejecting coloring inks and a reacting liquid which reacts with the coloring inks from a print head while scanning the print head with respect to the print medium, the print head having a nozzle array in which a plurality of nozzles for ejecting the coloring inks are arranged in a predetermined direction and a nozzle array in which a plurality of nozzles for ejecting the reacting liquid are arranged in the predetermined direction, and conveying the print medium in a direction different from the direction of scan of the print head, the method comprising:

a reacting liquid ejecting step of ejecting the reacting liquid from the print head to a predetermined band on the print medium during a first scan of the print head; and an ink ejecting step of ejecting the coloring inks from the print head to the predetermined band to which the reacting liquid has been ejected, during a second scan of the print head succeeding the first scan, in a direction opposite to a direction of the first scan, wherein the reacting liquid ejecting step ejects the reacting liquid to the predetermined band so that a ratio of an amount of reacting liquid impacting per a unit area to an amount of coloring inks impacting per the unit area is reduced as the first scan progresses.

2. The method of ink jet printing according to claim 1, further comprising a generating step of generating ejection data for the reacting liquid by thinning ejection data for the coloring inks at a predetermined thinning rate, wherein the generating step generates the ejection data for the reacting liquid corresponding to the predetermined band by varying the thinning rate depending on the position within the predetermined band.

3. The method of ink jet printing according to claim 1, wherein the amount of reacting liquid impacting per the unit area is the number of reacting liquid dots per the unit area, and the reacting liquid ejection step reduces the ratio of the amount of reacting liquid dots impacting per the unit area to the amount of coloring inks dots impacting per the unit area as the first scan progresses.

4. The method of ink jet printing according to claim 1, wherein the amount of reacting liquid impacting per the unit area is an amount of reacting liquid ejected per droplet, and the reacting liquid ejection step reduces the ratio of an amount of reacting liquid ejected per droplet to an amount of inks ejected per droplet as the first scan progresses.

5. A method of ink jet printing on a print medium for each band by ejecting coloring inks and a reacting liquid which reacts with the coloring inks from a print head while scanning the print head with respect to the print medium, the print head having arrays of ink ejecting nozzles in which a plurality of nozzles through which the coloring inks are ejected are arranged in a predetermined direction and an array of reacting liquid ejecting nozzles in which a plurality of nozzles through which the reacting liquid is ejected are arranged in the predetermined direction, the method comprising:

a reacting liquid ejecting step of ejecting the reacting liquid from the print head to a predetermined band on the print medium during a first scan of the print head in a forward direction;

a conveying step of conveying the print medium, in a direction different from the direction of scan of the print head, by an amount equal to a width of the predetermined band in the conveying direction, after the reacting liquid ejecting step; and an ink ejecting step of ejecting the coloring inks from the print head to the predetermined band to which the reacting liquid has been ejected, during a second scan of the print head in a backward direction after the conveying step, wherein the reacting liquid ejecting step ejects the reacting liquid to the predetermined band so that an area in which a ratio of an amount of reacting liquid impacting per a unit area to an amount of coloring inks impacting per the unit area is relatively high and an area in which the ratio is relatively low are mixed together within the predetermined band.

6. A method of ink jet printing on a print medium for each band by executing a step of ejecting coloring inks and a reacting liquid which reacts with the coloring inks from a print head while scanning the print head with respect to the print medium, the print head having arrays of ink ejecting nozzles in which a plurality of nozzles through which the coloring inks are ejected are arranged in a predetermined direction and an array of reacting liquid ejecting nozzles in which a plurality of nozzles through which the reacting liquid is ejected are arranged in the predetermined direction, and a step of conveying the print medium in a direction different from the direction of scan of the print head, the method comprising:

an ejection control step of controlling ejection of one of the coloring inks and the reacting liquid from the print head to a predetermined band on the print medium during a first scan of the print head, and ejection of the other of the coloring inks and the reacting liquid from the print head to the predetermined band to which the one of the coloring inks and the reacting liquid has been ejected, during a second scan of the print head following the first scan, wherein the ejection control step controls ejection of the reacting liquid to the predetermined band so that a ratio of an amount of reacting liquid impacting per a unit area to an amount of coloring inks impacting per the unit area is varied depending on a position within the predetermined band in the direction of scan.

7. An ink jet printing apparatus for printing on a print medium for each band by executing a step of ejecting coloring inks and a reacting liquid which reacts with the coloring inks from a print head while scanning the print head with respect to the print medium, the print head having arrays of ink ejecting nozzles in which a plurality of nozzles through which the coloring inks are ejected are arranged in a predetermined direction and an array of reacting liquid ejecting nozzles in which a plurality of nozzles through which the reacting liquid is ejected are arranged in the predetermined direction, and a step of conveying the print medium in a direction different from the direction of scan of the print head, the apparatus comprising:

ejection control means for controlling ejection of one of the coloring inks and the reacting liquid from the print head to a predetermined band on the print medium during a first scan of the print head, and ejection of the other of the coloring inks and the reacting liquid from the print head to the predetermined band to which the one of the coloring inks and the reacting liquid has been ejected, during a second scan of the print head following the first scan, wherein the ejection control means controls ejection of the reacting liquid to the predetermined band so that a ratio of an amount of reacting liquid impacting per a unit area to an amount of coloring inks impacting per the unit area is varied depending on a position within the predetermined band in the direction of scan.

* * * * *

UNITED STATES PATENT AND TRADEMARK OFFICE

CERTIFICATE OF CORRECTION

PATENT NO. : 7,048,356 B2
APPLICATION NO. : 10/962618
DATED : May 23, 2006
INVENTOR(S) : Ishikawa et al.

It is certified that error appears in the above-identified patent and that said Letters Patent is hereby corrected as shown below:

COLUMN 1:
Line 57, "hereinafter" should read --hereinafter be--.

COLUMN 5:
Line 18, "BRIED" should be --BRIEF--.
Line 55, "1026*b*disposed" should read --1026*b* disposed--.
Line 61, "in a" should read --in--.

COLUMN 9:
Line 34, "a" should read --an--.
Line 40, "comes" should read --come--.

COLUMN 12:
Line 24, "$Cl^{3-}$," should read --$Cl^{-}$,--.
Line 35, "polylalkylene" should read --polyalkylene--.
Line 36, "poyethylene" should read --polyethylene--; and "polypropylele" should read --polypropylene--.
Line 45, "1,3-dimetyl-2-imidazolidinone," should read --1,3-dimethyl-2-imidazolidinone,--.

COLUMN 13:
Line 39, "coplymer," (both occurrences) should read --copolymer,--.
Line 42, "stylene" should read --styrene--.
Line 43, "a, B-unsat-" should read --a, β-unsat- --.

COLUMN 14:
Line 25, "2-pyrrolidonne," should read --2-pyrrolidone,--.

COLUMN 15:
Line 38, "stylene," should read --styrene,--.

UNITED STATES PATENT AND TRADEMARK OFFICE

CERTIFICATE OF CORRECTION

PATENT NO. : 7,048,356 B2
APPLICATION NO. : 10/962618
DATED : May 23, 2006
INVENTOR(S) : Ishikawa et al.

It is certified that error appears in the above-identified patent and that said Letters Patent is hereby corrected as shown below:

COLUMN 16:
Line 5, "N-methylpyrrolidone:" should read --N-methyl pyrrolidone:--.
Line 7, "Acethylenol" should read --Acetylenol--.
Line 37, "Liquid" should read --liquid--.

COLUMN 17:
Line 45, "larage." should read --large.--.

Signed and Sealed this

Twenty-second Day of July, 2008

JON W. DUDAS
*Director of the United States Patent and Trademark Office*